US008141375B2

(12) United States Patent
Malpetti

(10) Patent No.: US 8,141,375 B2
(45) Date of Patent: Mar. 27, 2012

(54) DEVICE AND METHOD FOR CONTROLLING THE TEMPERATURE INSIDE A REFRIGERATING UNIT OF A COMBINED REFRIGERATOR-FREEZER

(75) Inventor: Roberto Malpetti, Lozza (IT)

(73) Assignee: ITW Industrial Components S.R. L., Milan (IT)

( * ) Notice: Subject to any disclaimer, the term of this patent is extended or adjusted under 35 U.S.C. 154(b) by 383 days.

(21) Appl. No.: 11/915,408

(22) PCT Filed: May 27, 2006

(86) PCT No.: PCT/EP2006/062646

§ 371 (c)(1),
(2), (4) Date: Nov. 26, 2007

(87) PCT Pub. No.: WO2006/125828

PCT Pub. Date: Nov. 30, 2006

(65) Prior Publication Data

US 2008/0196428 A1 Aug. 21, 2008

(30) Foreign Application Priority Data

May 27, 2005 (IT) ..... TO2005A0361

(51) Int. Cl.
*F25D 17/06* (2006.01)
*F25D 17/04* (2006.01)
*F25D 17/08* (2006.01)

(52) U.S. Cl. ..... 62/187; 62/186

(58) Field of Classification Search ..... 62/187, 62/186, 408; 236/49.3; 137/625.31
See application file for complete search history.

(56) References Cited

U.S. PATENT DOCUMENTS 4,009,590 A * 3/1977 Webb et al. ..... 62/180
4,033,736 A * 7/1977 Cann ..... 62/605
4,704,874 A * 11/1987 Thompson et al. ..... 62/187
4,732,009 A * 3/1988 Frohbieter ..... 62/89
(Continued)

FOREIGN PATENT DOCUMENTS

JP 5-52459 A * 3/1993
(Continued)

OTHER PUBLICATIONS

International Search Report for PCT/EP2006/062646 mailed Oct. 4, 2006.

*Primary Examiner* — Allen Flanigan
*Assistant Examiner* — Alexis Cox
(74) *Attorney, Agent, or Firm* — Lowe Hauptman Ham & Berner LLP

(57) ABSTRACT

A refrigerator-freezer of the combined type comprises a first and a second refrigerating units and a single cooling circuit for both units, which are fluid-dynamically and reciprocally connected by an air passage conduit; the temperature inside the first unit is controlled by a device comprising motorised interception means of the passage conduit; electronic control means of the motorised interception means, directly carried aboard a supporting body adapted in use to be arranged along the passage conduit; an electronic temperature sensor operatively and directly connected to the electronic control means, carried aboard the supporting body; and ventilator means, carried aboard the supporting body, operated by the electronic control means of the motorised interception means for selectively ensuring circulation of air by forced convection between the first and second refrigerating units along the passage conduit.

15 Claims, 1 Drawing Sheet

U.S. PATENT DOCUMENTS

| | | | | |
|---|---|---|---|---|
| 4,852,361 | A | 8/1989 | Oike et al. | |
| 4,920,758 | A | 5/1990 | Janke et al. | |
| 4,930,685 | A * | 6/1990 | Landers | 222/370 |
| 5,018,364 | A | 5/1991 | Chesnut et al. | |
| 5,201,888 | A | 4/1993 | Beach, Jr. et al. | |
| 5,876,014 | A | 3/1999 | Noritake et al. | |
| 5,896,749 | A * | 4/1999 | Livers, Jr. | 62/187 |
| 5,899,083 | A * | 5/1999 | Peterson et al. | 62/186 |
| 5,918,477 | A * | 7/1999 | Gall et al. | 62/354 |
| 5,983,654 | A * | 11/1999 | Yamamoto et al. | 62/187 |
| 6,176,097 | B1 * | 1/2001 | Kim | 62/187 |
| 6,343,477 | B1 * | 2/2002 | Mandel et al. | 62/187 |
| 6,735,975 | B2 * | 5/2004 | Jeon | 62/408 |
| 7,841,206 | B2 * | 11/2010 | Choi et al. | 62/408 |
| 8,037,701 | B2 * | 10/2011 | Anell et al. | 62/187 |
| 2002/0104325 | A1 * | 8/2002 | Mandel et al. | 62/187 |
| 2002/0139135 | A1 | 10/2002 | Noritake | |
| 2004/0050079 | A1 * | 3/2004 | Holmes et al. | 62/187 |
| 2004/0123610 | A1 * | 7/2004 | Nowak et al. | 62/187 |
| 2004/0144128 | A1 * | 7/2004 | Junge et al. | 62/441 |
| 2004/0163409 | A1 * | 8/2004 | Nakajima et al. | 62/505 |
| 2005/0050907 | A1 * | 3/2005 | Unger et al. | 62/187 |
| 2007/0119198 | A1 * | 5/2007 | Scrivener et al. | 62/187 |
| 2008/0196428 | A1 * | 8/2008 | Malpetti | 62/187 |
| 2008/0256964 | A1 * | 10/2008 | Lee et al. | 62/187 |
| 2010/0326096 | A1 * | 12/2010 | Junge et al. | 62/82 |

FOREIGN PATENT DOCUMENTS

| | | | |
|---|---|---|---|
| JP | 05071849 | A * | 3/1993 |
| JP | 2011002141 | A * | 1/2011 |

* cited by examiner

DEVICE AND METHOD FOR CONTROLLING THE TEMPERATURE INSIDE A REFRIGERATING UNIT OF A COMBINED REFRIGERATOR-FREEZER

RELATED APPLICATIONS

The present application is based on International Application No. PCT/EP2006/062646 filed May 27, 2006 and claims priority from Italian Application Number TO2005A000361 filed May 27, 2005, the disclosures of which are hereby incorporated by reference herein in their entirety.

TECHNICAL FIELD

The present invention relates to a method and device for controlling the temperature inside a refrigerating unit of a refrigerator-freezer of the combined or two-door type, i.e. in which two reciprocally separate refrigerating units are present, one for the conservation of foods at sub-zero temperatures (freezer unit) and one for the conservation of foods at above-zero Centigrade temperatures (fresh food refrigerating unit) served by a single cooling circuit operated by a single compressor. The invention is particular useful for combined refrigerator-freezers of the ventilated type, also known as "no-frost" appliances, but also for static appliances.

BACKGROUND ART

It is known that in household appliances of the aforesaid type, temperature control in the above-zero refrigerating unit is ensured only indirectly, through a fluid-dynamic connection between the two units determined by a passage conduit, along which motorised choking means constituted by a device known as a "damper" are arranged; such device is controlled by an electromechanical or electronic thermostat which appropriately moves the choking means, while an independent control system driven by the temperature present in the freezer unit operates the cooling circuit compressor, for example on the basis of the temperatures measured near the evaporator of the circuit arranged close to the sub-zero temperature refrigerating unit (freezer unit); the choking means consist in at least one mobile shutter member carried by a support fittable within the air passage conduit between the two refrigerating units, and in motor means of the shutter member. The same control system of the compressor also operates a ventilator arranged upstream of the evaporator, which ensures forced air ventilation in both refrigerating units (ventilated or "no-frost" cycle).

The solution described above is not entirely satisfactory. Indeed, an accurate temperature control, in particular in the above-zero unit, which is also the unit most frequently opened by the user, is not always optimal, which may also cause the early perishing of the foods conserved within. Furthermore, the solution described above can in practice only be used in ventilated or "no-frost" refrigerators-freezers, in which the presence of the ventilator ensures the forced passage of air between the two refrigerating units.

Finally, the need of maintaining adequately cool the above-zero refrigerating unit, which is more frequently opened and which consequently "warms up" more frequently, forces to adopt a temperature control cycle which entails a high waste of energy.

DISCLOSURE OF INVENTION

It is the object of the present invention to obviate to the aforesaid drawbacks by providing a device and method for controlling the temperature inside the above-zero Centigrade refrigerating unit which is simple, reliable, cost-effective and small in size.

The present invention therefore relates to a device for controlling the temperature inside a first refrigerating unit of a household appliance of the combined type, in particular a refrigerator-freezer, comprising said first refrigerating unit and a second refrigerating unit, both served by a single cooling circuit and fluid-dynamically connected to each other by an air passage conduit, as defined in claim 1.

In particular, the control device of the invention comprises a supporting body adapted to be in use arranged along the air passage conduit between the two refrigerating units; selective interception motorised means of the passage conduit carried by the supporting body; and electronic control means of the selective interception motorised means, carried directly aboard said supporting body and served by an electronic temperature sensor directly connected to the same and arranged so as to measure the temperature either along the connection conduit or within the first refrigerating unit, i.e. the one maintained at above-zero Centigrade temperature (definable by the user as "refrigerating unit", in contrast with the second unit, maintained at sub-zero Centigrade temperature and therefore definable as "freezer unit").

The electronic temperature sensor is preferably but not necessarily directly carried aboard the supporting body, on side facing the first refrigerating unit and, in a preferred variant, the control device also includes ventilator means, operated by the control means of the selective interception motorised means, also directly carried aboard the supporting body, so as to be in use arranged within the passage conduit and adapted to selectively ensure air circulation by forced convection between the first and the second refrigerating units when said selective interception motorised means are in an operative position in which said passage conduit is at least partially open.

The invention also relates to a method for controlling the temperature inside the aforesaid said first refrigerating unit as defined in claim 10.

In this way, as soon as the need is detected, not only is the communication passage between the two refrigerating units opened to allow the passage of cold air from the freezer unit to the refrigerating unit, but also such passage may be positively determined by forced convection if ventilation means are present aboard the damper. This all independently of the centralised temperature control system of the household appliance, to therefore obtain restoration of optimal temperature in the refrigerating unit without (or before) operating the compressor and the possible ventilator which directly serve only the freezer unit by the centralised control system.

This essentially allows, with the simple addition of a temperature sensor, to avoid operation of the compressor and of the possible ventilator which determine unnecessarily cooling of the freezer unit only to maintain the temperature set by the thermostat in the refrigerating unit at above-zero temperature.

The arrangement of such additional temperature sensor, plus an auxiliary ventilator (which only facilitates the circulation of air in the passage conduit and does not have the task of avoiding the formation of ice, and consequently may have minimum power and dimensions) directly on the supporting body of an otherwise normal "damper" device, along with the selection of an electronic sensor and the assembly aboard the damper also of electronic controls dedicated to such additional temperature sensor, finally allows to contain costs and dimensions and to implement the invention also on household appliances provided with an electromechanical thermostat temperature control system or appliances of the static type.

BRIEF DESCRIPTION OF THE DRAWINGS

Further features and advantages of the present invention will be apparent from the following description of a non-limitative embodiment thereof, with reference to the accompanying drawing, in which.

BEST MODE FOR CARRYING OUT THE INVENTION

Figure 1:
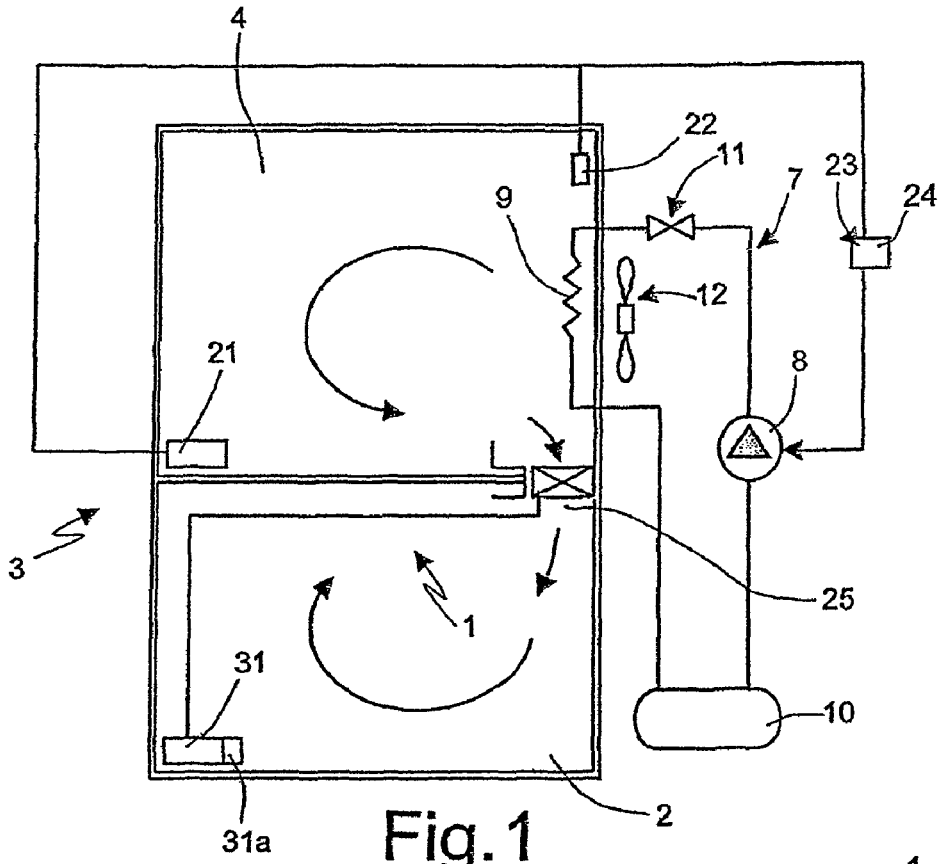
FIG. 1 schematically shows a household appliance of the combined type, provided with two refrigerating units served by a single cooling circuit, provided with the temperature control device of the invention.

With reference to FIG. 1, it is indicated as a whole by 1 a control device of the temperature inside a refrigerating unit 2, in particular of a household appliance 3 of the combined type (refrigerator-freezer), provided with a second refrigerating unit 4; refrigerating means consisting of a cooling circuit 7 of the known type, comprising a compressor 8, an evaporator 9, a condenser or radiator 10 and an expansion valve 11, serving both refrigerating units 2 and 4; in particular, the evaporator 9 is arranged close to the refrigerating unit 4, intended in use to remain at sub-zero Centigrade temperatures (freezer unit). In order to prevent the formation of ice due to freezing of condensation, circuit 7 is provided with a defrosting ventilator 12 of the known type, arranged near the evaporator 9, in particular upstream of the same with respect to an air flow (indicated by the arrow in FIG. 1) which circulates in use in unit 4 during the ventilated (no-frost) cooling cycle.

The household appliance 3 further comprises control means of the temperature inside the refrigerating units 2 and 4, comprising a thermostat 21, a temperature sensor 22 connected to the thermostat 21 and arranged near the evaporator 9, control means 23 of the cooling circuit 7, controlled in the known way by the thermostat 21, comprising a control unit (not necessarily electronic) 24 and a passage conduit 25 which according to a known diagram fluid-dynamically and connects to each other the refrigerating units 2 and 4 to allow in use a circulation of air between the two units 4 and 2, for example when the ventilator 12 is running.

According to the invention, the mentioned control means of the temperature inside the refrigerating units 2 and 4 also comprise the control device 1 of the temperature inside refrigerating unit 2 only, which is intended in use to work at above-zero Centigrade temperatures.

Figure 2:
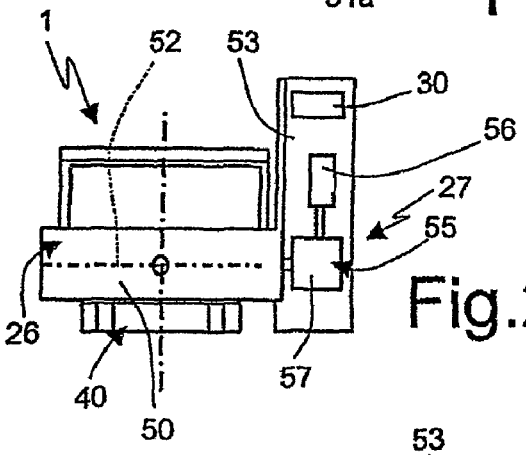
FIGS. 2, 3 and 4 show on a magnified scale and again only schematically, three orthogonal views of the device according to the invention.
Figure 3:
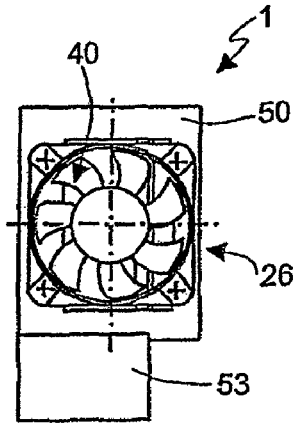
Figure 4:
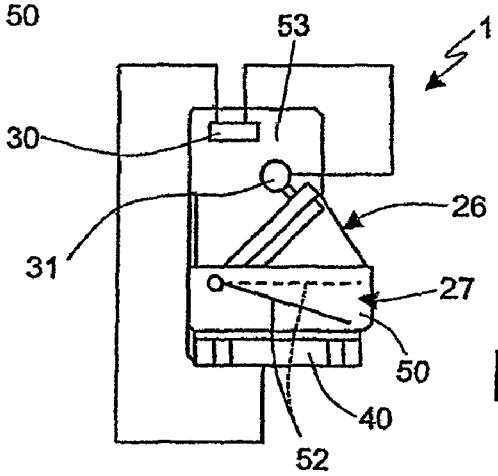

The control device 1 comprises (FIGS. 2-4), in a known way, a supporting body 26 adapted to be in use arranged along the air passage conduit 25 between units 2 and 4 and selective interception motorised means 27 of the air passage conduit 25, carried by the supporting body 26; and, according to the invention, electronic control means 30 of said selective interception motorised means 27, directly carried aboard the supporting body 26; and an additional electronic temperature sensor 31, which is operatively and directly connected to the electronic control means 30 of the selective interception motorised means 27, and which is arranged so as to detect, unlike the sensor 22, the temperature along the connection conduit 25, in particular towards the unit 2, or directly within the refrigerating unit 2 itself.

The electronic temperature sensor 31 is directly carried aboard the supporting body 26, on a side facing in use the refrigerating unit 2 (FIG. 4) and does not require connection to the electrical circuit of the control means 23, in particular the control unit 24, and the thermostat 21, for example as it is provided with its own thermostat 31*a*.

According to a preferred aspect of the invention, device 1 further comprises ventilator means 40 (auxiliary, as shown below, with respect to the defrosting ventilator 12), operated by the same electronic control means 30 of the selective interception motorised means 27, directly carried aboard the supporting body 26, so as to be arranged in use within the passage conduit 25 and adapted to selectively ensure a circulation of air by forced convection between the refrigerator units 2 and 4 when the selective interception motorised means 27 are found in an operative position (schematically shown with a solid line in FIG. 4), in which they leave the passage conduit 25 at least partially open. The ventilator means 40 are in particular carried by the supporting body 26 on an opposite side of the electronic temperature sensor 31, i.e. they result in use facing the refrigerating unit 4.

According to the example shown, the supporting body 26 comprises a first casing portion 50 shaped so as to define in use a passage section of the air passage conduit 25 between the refrigerating units 2 and 4 and accommodated in use coaxially within the same conduit 25.

The first casing portion 50 of the supporting body 26 directly carries at least one respective shutter member 52 (shown with a dotted line in FIG. 4, in an operative total choking position of the conduit 25 and with a solid line in a partial choking position of the conduit 25), belonging to the mentioned selective interception motorised means 27.

The supporting body 26 further comprises a second casing portion 53 arranged by the side of the first casing portion 50 and internally accommodating electrical motors 55 for the shutter member 52, belonging to the selective interception motorised means 27, and the electronic control means 30 of the latter.

In particular, the electronic motor means 55 consist in a simple electrical motor 56, preferably a reversible polarity motor, operatively coupled to the shutter member 52 through a motor reducer assembly 57 or with an incorporated motor reducer in turn coupled to the shutter member 52. In this way, when controlled by the control means 30, the shutter member 52 is adapted to selectively intercept the conduit passage section 25 (in the dotted line position in FIG. 4), to interrupt the fluid-dynamic connection between units 2 and 4, or to leave the passage conduit 25 open (in the solid line position in FIG. 4). The ventilator means 40 are coaxially carried by the first casing portion 50.

According to the invention, by means of device 1, the temperature inside the refrigerating unit 2 is controlled at predetermined cycles by means of the following steps: firstly the temperature inside refrigerating unit 2 (or a temperature strictly correlated to this, as the temperature possibly present in a downstream segment of the air passage conduit 25) is measured by sensor 31; if the measured temperature is higher than a first predetermined threshold, the control means 30 operate the interception motorised means 27 so as to put unit 2 in fluid-dynamic communication with unit 4, which is much colder, through the passage conduit 25, thus allowing the passage of air between the two refrigerating units 2, 4 by convection.

To facilitate the cooling of unit 2, if ventilator means 40 are present they are operated by the same control means 30, simultaneously with the selective interception motorised means 27, to determine the passage of air between the two refrigerating units 2 4, by forced convection. Further, it is always performed the traditional step of measuring, at prefixed cycles, the temperature inside the freezer unit 4 by means of the temperature sensor 22, or a temperature directly proportional to it, for example near the evaporator 9, along with a step of operating the compressor 8 and the ventilator 12, if the measured temperature is higher than a second predetermined threshold. The latter and the first predetermined threshold are established on the basis of the indication, for example, of thermostat 21.

Obviously, according to the invention, the operation of the device 1 may trigger exceeding of the second predetermined threshold of the unit 4, causing operation of the cooling circuit 7. In such case, if ventilator 12 is present, ventilator means 40 may at this point be deactivated, for example by control means 30 following, for example, the increase of temperature variation speed measurable by sensor 31, for the consequent higher flow of air produced by the ventilator 12.

Thanks to the auxiliary ventilator means 40, temperature control in unit 2 is much prompter and, above all, can be actuated in the described way also in absence of the ventilator 12, i.e. in household appliances of the non-ventilated type.

The invention claimed is:

1. A temperature control device of an appliance having a first refrigerating unit and a second refrigerating unit, wherein the first and the second refrigerating units are cooled by a single cooling circuit and are fluid-dynamically connected to each other by an air passage conduit;

an evaporator disposed in the second refrigerating unit;

the temperature control device comprising:

a supporting body arranged along said air passage conduit;

a motorized shutter assembly disposed on the supporting body, wherein the motorized shutter assembly comprises:

at least one shutter element configured to restrict or allow airflow through said air passage conduit;

an electric motor configured to operate the at least one shutter element;

means for controlling said electric motor disposed on the supporting body; and an electronic temperature sensor electrically coupled to said means for controlling said electric motor and configured to measure a temperature associated with said first refrigerating unit; and a defrosting ventilator disposed upstream of the evaporator with respect to an air flow; and a first ventilator disposed on the supporting body and electrically coupled to said means for controlling said electric motor and being configured to actuate the first ventilator only when the passage conduit is at least partially open, and wherein said means for controlling is configured to control said shutter element for allowing said passage conduit to remain at least partially open when said first ventilator is deactivated, thereby forcing a circulation of air between said first and second refrigerating units.

2. The temperature control device according to claim 1, wherein the electronic temperature sensor is carried directly aboard said supporting body, on a side facing towards said first refrigerating unit.

3. The temperature control device according to claim 1, wherein the first ventilator is carried by said supporting body on a side opposite to said electronic temperature sensor.

4. The temperature device according to claim 1, wherein the supporting body comprises:

a first casing portion shaped so as to define a passage section of said air passage conduit between said first and second refrigerating units and coaxially housed inside the air passage conduit, said first casing portion of the supporting body directly supporting at least one shutter element of said motorized shutter assembly; and at least one second casing portion arranged laterally to said first casing portion and internally housing the electrical motor associated with the at least one shutter element and said electronic control unit.

5. The temperature control device according to claim 4, wherein the electric motor is a reversible polarity electrical motor operatively coupled to said at least one shutter element via a motor reducer unit.

6. The temperature control device according to claim 4, wherein the first ventilator is carried coaxially by said first casing portion.

7. A household appliance, comprising:

a first refrigerating unit and a second refrigerating unit served by a single cooling circuit and fluid-dynamically connected to each other by an air passage conduit; an evaporator disposed in the second refrigerating unit; and a temperature control device configured to control the temperature inside the first and second refrigerating units, the temperature control device including at least a first temperature sensor positioned in the second refrigerating unit, the temperature control device comprising:

a supporting body arranged along the air passage conduit;

a motorized shuttering device disposed on the supporting body; wherein the motorized shuttering device comprises:

at least one shutter element configured to restrict or allow airflow through said air passage conduit;

an electric motor disposed on the supporting body; means for controlling said electric motor; and a second temperature sensor electrically coupled to said means for controlling said electric motor and configured to measure a representative temperature of the first refrigerating unit; and a defrosting ventilator disposed upstream of the evaporator with respect to an air flow; and a first ventilator disposed on the supporting body and electrically coupled to said means for controlling said electric motor and being configured to actuate the first ventilator only when the passage conduit is at least partially open, and wherein said means for controlling is configured to control said shutter element for allowing said passage conduit to remain at least partially open when said first ventilator is deactivated, thereby forcing an air flow between said first and second refrigerating units.

8. A method of controlling a temperature inside a first refrigerating unit served by a cooling circuit that additionally serves a second refrigerating unit, the first and second refrigerating units being fluid-dynamically connected to each other by an air passage conduit provided with a motorized shuttering device, the method comprising: providing an evaporator disposed in the second refrigerating unit; measuring the temperature inside the first refrigerating unit via a first temperature sensor;

if the measured temperature inside the first refrigerating unit is higher than a first predetermined threshold, operating the at least one motorized shuttering device so as to put into fluid-dynamic communication said first refrigerating unit with said second refrigerating unit via said passage conduit for permitting a passage of air between the two refrigerating units by convection; providing a defrosting ventilator disposed upstream of the evaporator with respect to an air flow; and actuating a first ventilator only when the passage conduit is at least partially open, and allowing said passage conduit to remain at least partially open when said first ventilator is deactivated, thereby forcing an air flow between the first and second refrigerating units through the air passage conduit.

9. The method according to claim 8, further comprising:

measuring a temperature inside said second refrigerating unit via a second temperature sensor; and actuating a compressor, disposed in the cooling circuit, if the temperature measured via the second temperature sensor is higher than a second predetermined threshold.

10. The temperature control device according to claim 1, wherein the electronic control unit is further configured to selectively deactivate the first ventilator, during the period when the passage conduit is at least partially open, based on a temperature variation measurable by the electronic temperature sensor.

11. The household appliance of claim 7, wherein the electronic control unit is further configured to selectively deactivate the first ventilator, during the period when the passage conduit is at least partially open, based on a temperature variation measurable by the second electronic temperature sensor.

12. The method according to claim 8, wherein the selective actuation of the first ventilator comprises selectively deactivating the first ventilator, during the period when the passage conduit is at least partially open, based on a temperature variation measurable by the first temperature sensor.

13. The method according to claim 9, further comprising:

actuating a second ventilator, disposed in the cooling circuit, based on a temperature variation measurable by the first temperature sensor when the first ventilator is deactivated during the period when the passage conduit is at least partially open.

14. The temperature control device according to claim 1, wherein the cooling circuit includes:

a compressor actuated if a measured temperature inside the second refrigerating unit is higher than a predetermined threshold; and said defrosting ventilator is activated based on a temperature variation measurable by the electronic temperature sensor when the first ventilator is deactivated during when period the passage conduit is at least partially open.

15. The household appliance according to claim 7, wherein the cooling circuit includes:

a compressor actuated if a measured temperature inside the second refrigerating unit is higher than a predetermined threshold; and the defrosting ventilator is activated based on a temperature variation measurable by the second temperature sensor when the first ventilator is deactivated during the period when the passage conduit is at least partially open.

* * * * *